US010661144B2

(12) United States Patent
Kim et al.

(10) Patent No.: US 10,661,144 B2
(45) Date of Patent: May 26, 2020

(54) GOLF SWING TRAINING AID

(71) Applicants: Phillip Kim, Delray Beach, FL (US); Juan David, Fort Lauderdale, FL (US)

(72) Inventors: Phillip Kim, Delray Beach, FL (US); Juan David, Fort Lauderdale, FL (US)

(73) Assignee: Phillip Kim, Boca Raton, FL (US)

( * ) Notice: Subject to any disclaimer, the term of this patent is extended or adjusted under 35 U.S.C. 154(b) by 0 days.

(21) Appl. No.: 16/298,500

(22) Filed: Mar. 11, 2019

(65) Prior Publication Data

US 2019/0314702 A1 Oct. 17, 2019

Related U.S. Application Data

(60) Provisional application No. 62/656,120, filed on Apr. 11, 2018.

(51) Int. Cl.

| | |
|---|---|
| ***A63B 69/36*** | (2006.01) |
| ***A63B 53/04*** | (2015.01) |
| *A63B 102/32* | (2015.01) |

(52) U.S. Cl.
CPC ..... *A63B 69/3632* (2013.01); *A63B 53/0466* (2013.01); *A63B 2102/32* (2015.10)

(58) Field of Classification Search
CPC ..... A63B 69/3632; A63B 53/0466; A63B 2102/32
USPC ..... 473/219–256, 282, 286, 345, 409, 423, 473/505, 513
See application file for complete search history.

(56) References Cited

U.S. PATENT DOCUMENTS

| | | | | | |
|---|---|---|---|---|---|
| 1,994,207 | A * | 3/1935 | Ahles | A63B 69/3632 | 473/235 |
| 2,057,821 | A * | 10/1936 | Costello | A63B 69/3632 | 473/235 |
| 2,094,766 | A * | 10/1937 | Costello | A63B 69/3632 | 473/138 |
| 2,157,415 | A * | 5/1939 | Jones | A63B 69/3632 | 473/235 |
| 2,609,198 | A * | 9/1952 | Armstrong | A63B 57/0037 | 294/19.2 |
| 4,580,784 | A * | 4/1986 | Brill | A63B 47/02 | 473/286 |
| 6,257,635 | B1 * | 7/2001 | Torelli | A63B 47/02 | 294/19.2 |
| 6,878,071 | B1 * | 4/2005 | Schwieger | A63B 47/02 | 294/19.2 |
| 2016/0375333 | A1 * | 12/2016 | Fryer | A63B 67/02 | 473/409 |

* cited by examiner

*Primary Examiner* — Nini F Legesse
(74) *Attorney, Agent, or Firm* — Leason Ellis LLP

(57) ABSTRACT

A golf swing training aid includes a golf club having a shaft and a club head. The club head has a hollow compartment for capturing a golf ball and is defined by a top wall, an opposing bottom wall, and a real wall. The club head has an open front face that forms an entrance into the hollow compartment. The club head has a slot formed within the bottom wall and being open along the front face of the club head for receiving a golf tee as the club head contacts the golf ball. An internal movable part is provided within the hollow compartment and moves between a raised position which allows the golf ball to travel to a rear ball capture space within the hollow compartment and a lowered position which is configured for capturing the golf ball within rear ball capture space located between the rear wall and the internal movable part.

18 Claims, 6 Drawing Sheets

GOLF SWING TRAINING AID

CROSS REFERENCE TO RELATED APPLICATION

The present application claims priority to and the benefit of U.S. patent application Ser. No. 62/656,120, filed Apr. 11, 2018, which is hereby incorporated by reference in its entirety.

TECHNICAL FIELD

The present invention relates to golf training aids and more particularly, relates to a full swing golf training aid (golf swing trainer) that is configured to teach a user how to properly swing a golf club.

BACKGROUND

The sport of golf is a very mechanically challenged sport in that a user not only must understand the rules but also more importantly, must master the mechanics of striking and driving the golf ball. In particular, the user must understand and learn the proper stance for striking the golf ball and the proper grip on the golf club. Yet another aspect to master is how to properly swing the golf club so that the golf ball is squarely struck resulting in the golf ball travelling in the desired direction.

Swinging the golf club can be characterized by a number of distinct phases/stages. More particularly, a golf swing is initiated by starting a backswing. The backswing is where the golfer lifts the club from its starting position and brings it above his/her head. There are generally three distinct phases of the backswing, namely, (1) move the hands straight back while keeping them close to your back leg, wherein as the club head hinges backward, the shaft of the club becomes almost parallel to the ground; (2) continue a slight wrist break as the golfer moves his/her arm parallel to the ground and the club should be roughly perpendicular to the golfer's left arm (for right-handed golfers); and (3) rotate the torso back even further so that the club head travels slightly behind the golfer's hands at the top of the backswing.

The next stage of the swing is that the golfer must follow through with the downswing. When swinging down, "haul" the head of the club so that it lags behind everything else, and allow the 90 degree forearm/shaft angle to increase, then unwind rapidly through the impact area. This creates tremendous club head speed while allowing the body to move relatively slowly and maintain control.

The golfer should also make sure to have the shaft leaning forward toward the target at the moment of impact. This will help to have the face of the club face square at impact, an important factor in directional control.

Finally, the golfer must remember to follow through. It isn't critical how far back the golfer takes the club, but if the golfer releases the club correctly, the golfer should follow through completely. The golfer's belt buckle will be facing the target, the club will be behind the golfer, and the golfer will be balanced on his/her lead foot with the back foot balanced on its toe. The golfer should be able to comfortably hold this finish as the golfer watches the ball fly off into the distance. The golfer should remember to keep his/her eyes on the ball during the backswing, downswing, and follow through.

If the golfer does not master how to properly take a full swing, the ball will not be properly struck and will travel in an undesired direction. A golfer is slicing the ball if the ball is traveling to slightly the left (for a right-handed golfer) and then dramatically to the right. A golfer is hooking the ball if the ball travels slightly to the right (for a right-handed golfer) and then dramatically to the left. This happens when the ball has a counterclockwise spin, meaning that it's being hit from right to left instead of from back to front.

Due to mechanical complexity of the game of golf, there is a desire and need to provide a golf swing training aid.

SUMMARY

A golf swing training aid includes a golf club having a shaft and a club head. The club head has a hollow compartment for capturing a golf ball and is defined by a top wall, an opposing bottom wall, and a real wall. The club head has an open front face that forms an entrance into the hollow compartment. The club head has a slot formed within the bottom wall and being open along the front face of the club head for receiving a golf tee as the club head contacts the golf ball. An internal movable part is provided within the hollow compartment and moves between a raised position which allows the golf ball to travel to a rear ball capture space within the hollow compartment and a lowered position which is configured for capturing the golf ball within rear ball capture space located between the rear wall and the internal movable part.

BRIEF DESCRIPTION OF THE DRAWING FIGURES

DETAILED DESCRIPTION OF CERTAIN EMBODIMENTS

Figure 1:
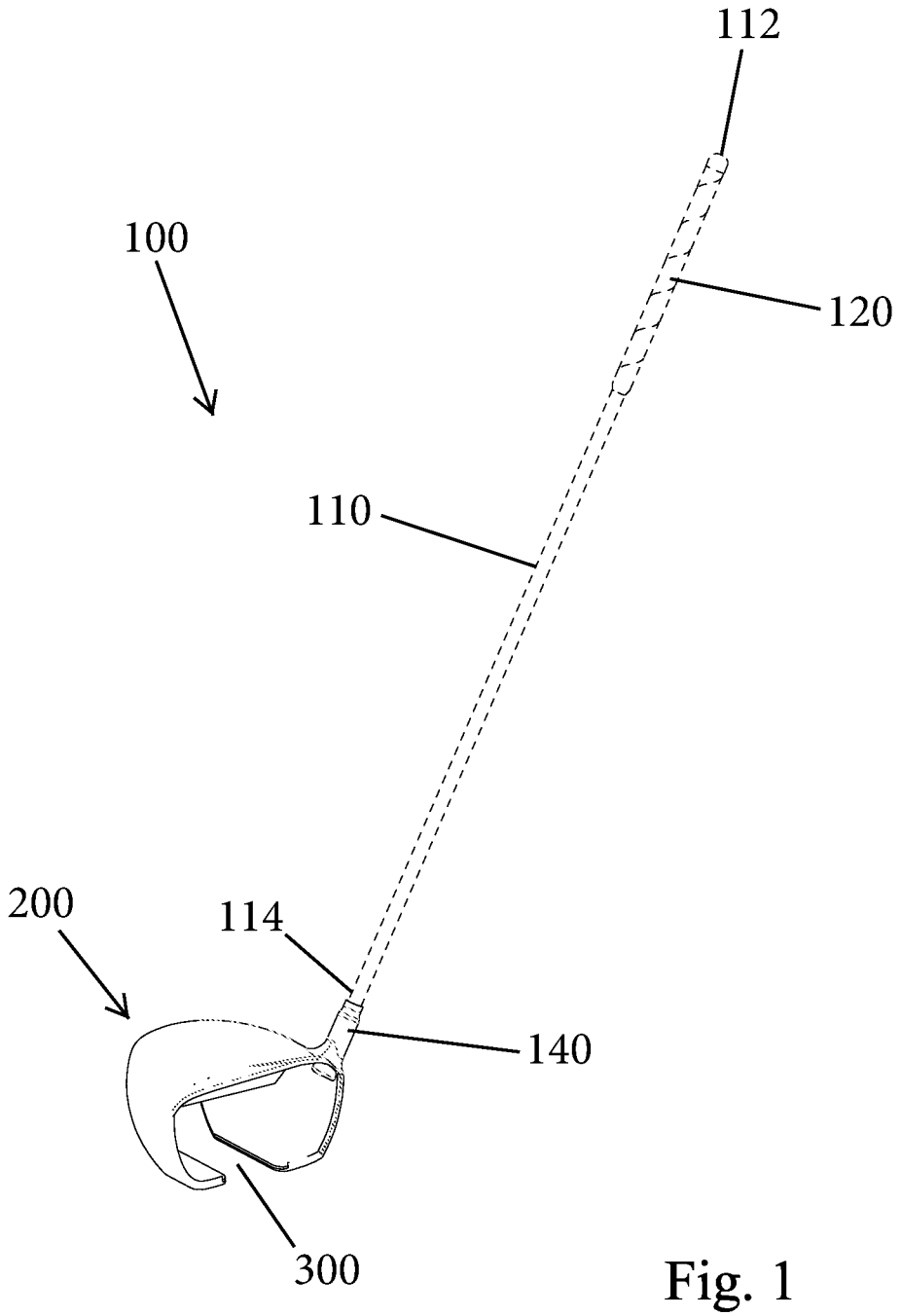
FIG. 1 is a front perspective view of a golf swing training aid according to one exemplary embodiment.
Figure 2:
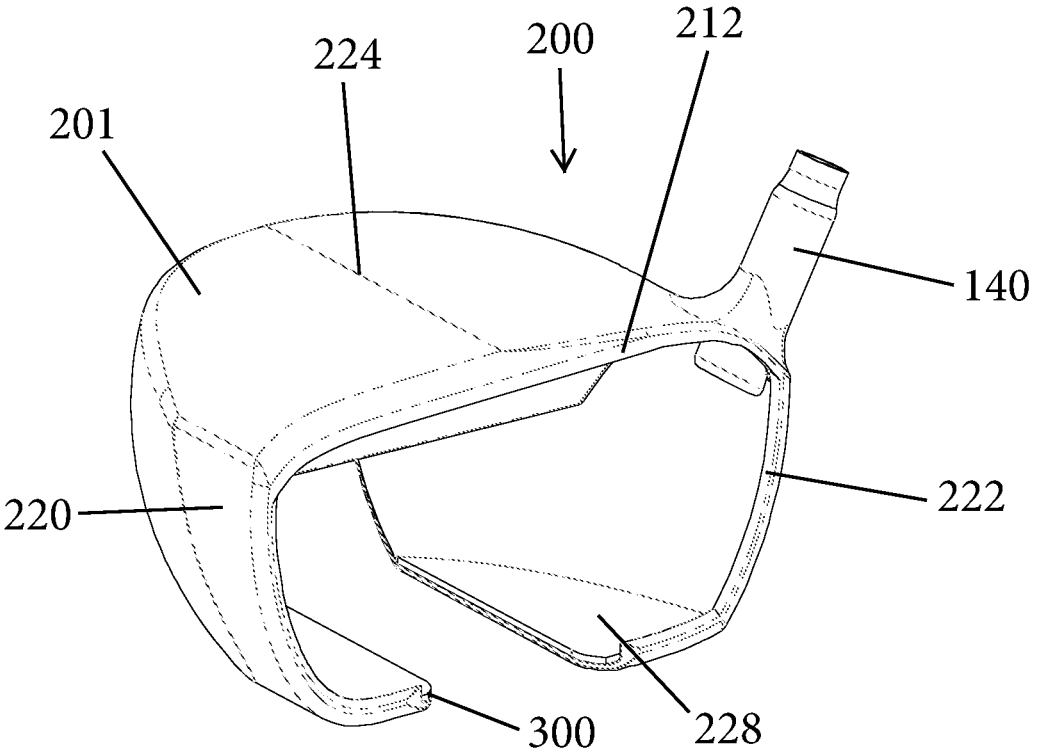
FIG. 2 is a front perspective view of a club head that represents the golf swing training aid.
Figure 3:
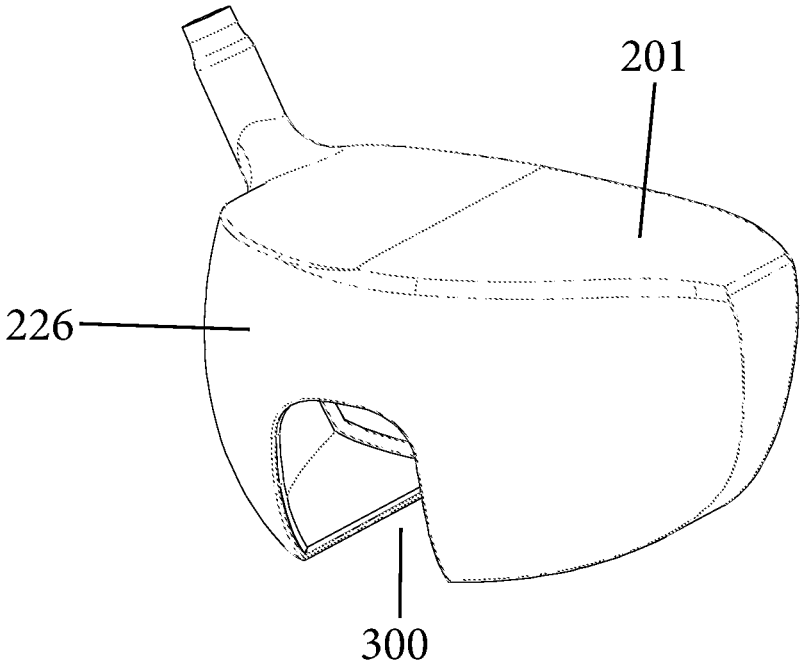
FIG. 3 is rear perspective view of the club head.

FIGS. 1-6 illustrate a golf swing training aid (golf swing trainer) 100 in accordance with one embodiment. The golf swing training aid 100 is in the form of specially constructed golf club that is generally formed of a shaft 110 and a club head 200. As is known, the shaft 110 is an elongated structure that has a proximal end 112 and an opposite distal end 114. At the proximal end 112, a shaft grip 120 can be provided. The shaft grip 120 is wrapped around the outer surface of the shaft 110 and is designed to provide enhanced grip to the user. The shaft 110 can have a uniform diameter or it can have an inward taper in a direction toward the distal end 114. The distal end 114 of the shaft 110 is attached to the club head 200 using any number of conventional techniques. In the illustrated embodiment, the shaft 110 is detachably connected to the club head 200. For example, the distal end 114 of the shaft 110 can include a first fastener that mates with a second fastener that is part of the club head 200 and more particularly, the first fastener can be shaft threaded screw, while the second fastener 140 can be a threaded hosel.

The club head 200 has a hollow body 201 that is configured to capture a golf ball 10 when a proper swing is executed by the user in that the user swings the golf club at the golf ball 10 that is sitting on a golf tee. The body 201 of the club head 200 that in accordance with the present invention is a hollow structure that is open along its front face 212 (which normally would be a club face) and is partially open along its rear face 214. In particular, the body 201 is defined by a pair of opposing side walls 220, 222, a top wall 224 and a rear wall 226. The body 201 also include a bottom wall 228 opposite the top wall 224 and the front face 212 is an open face that lacks any ball strike surface and therefore, as described herein, serves as a ball receiving mechanism. The bottom wall 228 can have a flat (planar) surface. The body 201 can be an integral structure in that walls 220, 222, 224, 226, 228 can be formed as a single structure.

The second fastener 140 (e.g., hosel) is located at and protrudes outwardly from the top wall 224 at the interface with the second side wall 222.

The distance between the top wall 224 and the bottom wall 228 is selected so that the golf ball 10 can freely travel therebetween and can enter the hollow body 201 along the front face 212.

The body 201 has a slot 300 that is formed therein and in particular, the slot 300 is formed within the bottom wall 228 and also is partially formed along the rear wall 226. The slot 300 extend completely across the entire bottom wall 228 from its forward edge to its rear edge. The slot 300 is continuous in nature and wraps around and is formed in the lower portion of the rear wall 226. In other words, the slot 300 extends from a bottom edge of the rear wall 226 and extends towards a top edge of the rear wall 226. The slot 300 can terminate approximately at a midpoint of the rear wall 226 or generally within the top half of the rear wall 226. However, the slot 300 can equally terminate in a bottom half of the rear wall 226. The slot 300 can thus generally have an L shape with the length of the slot 300 being greater in the bottom wall 228 than the length in the rear wall 226.

The slot 300 has a width that is less than the diameter of the golf ball 10 and therefore, the golf ball 10 cannot exit through the slot 300 and for that matter cannot enter through the slot 300. Entry of the golf ball 10 into the hollow body 201 is instead through the open front face thereof.

While the slot 300 is shown as having a constant width, the slot 300 can have a variably width. For example, the width of the slot 300 in the bottom wall 228 can be different than the width of the slot 300 in the rear wall 226; however, in both instances, the width of the slot 300 in both the rear wall 226 and bottom wall 228 must be less than the diameter of the golf ball 100 to prevent the golf ball from exiting through the slot 300.

The slot 300 serves several purposes. First, the slot 300 serves as a golf tee accommodation slot in that when the golf club is swung, in order for the golf ball 10 to enter into the hollow ball capturing interior of the club head 201, the golf ball 10 must pass into the hollow body 201 to be captured. Since the golf ball 10 is resting on the golf tee, the club head 201 must be constructed such that the club head 201 does not contact and strike the golf tee. Thus, the slot 300 is intended to accommodate the golf tee since as the user swings the club head and the golf ball 10 enters the hollow body 201 at the front face thereof, the golf tee enters into the slot 300 as the golf ball 10 enters the hollow interior of the club head 201. As the user follows through with the swing, the golf tee passes through and exits the slot 300 along the portion of the slot 300 that is formed along the rear wall 226. In this way, the user can take a full swing and the golf tee does not strike the club head 201 and interfere with the capture of the golf ball 10 within the hollow interior of the club head 201.

The slot 300 also serves a second function in that it provides an air vent. In particular, as the club head 200 is swung, air is forced into hollow interior of the head body 201 and the portion of the slot 220 in the rear wall 226 defines an air vent and allows air to flow cleanly through the hollow interior of the club head 200.

The club head 200 also has a movable internal part 400 that facilitates in the capturing of the golf ball 10. In particular, the movable internal part 400 is swinging hinge member (pivotable door) that is coupled to the underside of the top wall 224.

Figure 4:
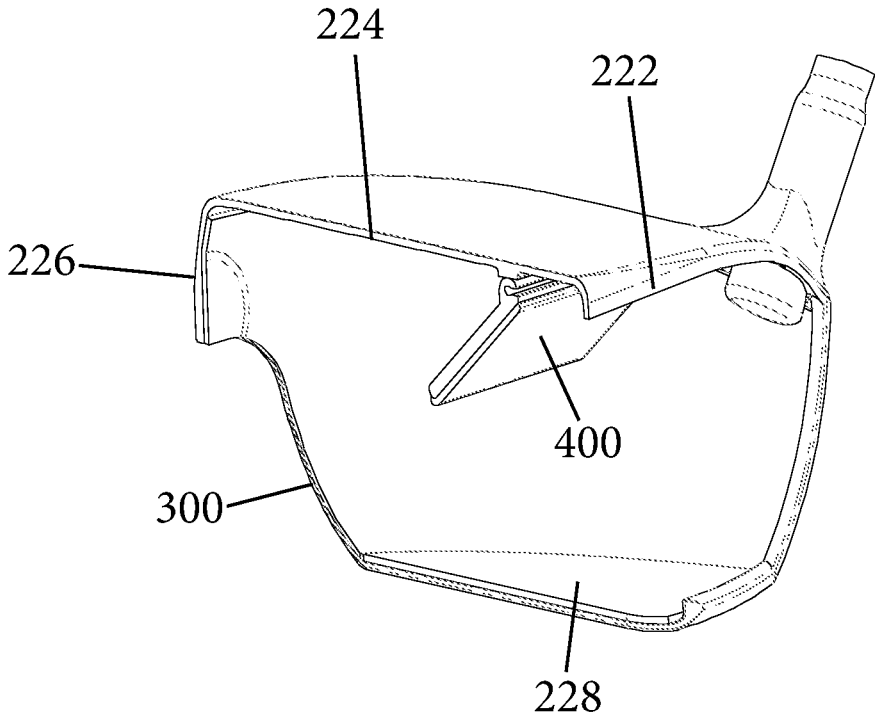
FIG. 4 is a front perspective view in cross-section of the club head showing a hinge element in a first position prior to reception of a ball.
Figure 5:
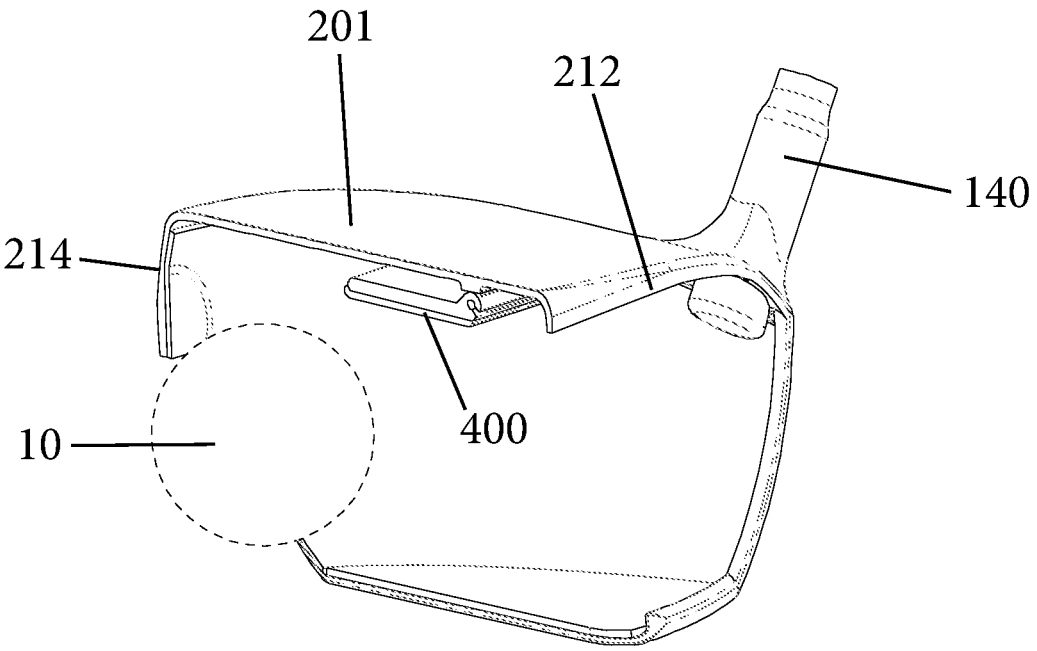
FIG. 5 is a front perspective view in cross-section of the club head showing the hinge element in a second position as the ball is received and passes under the hinge element.
Figure 6:
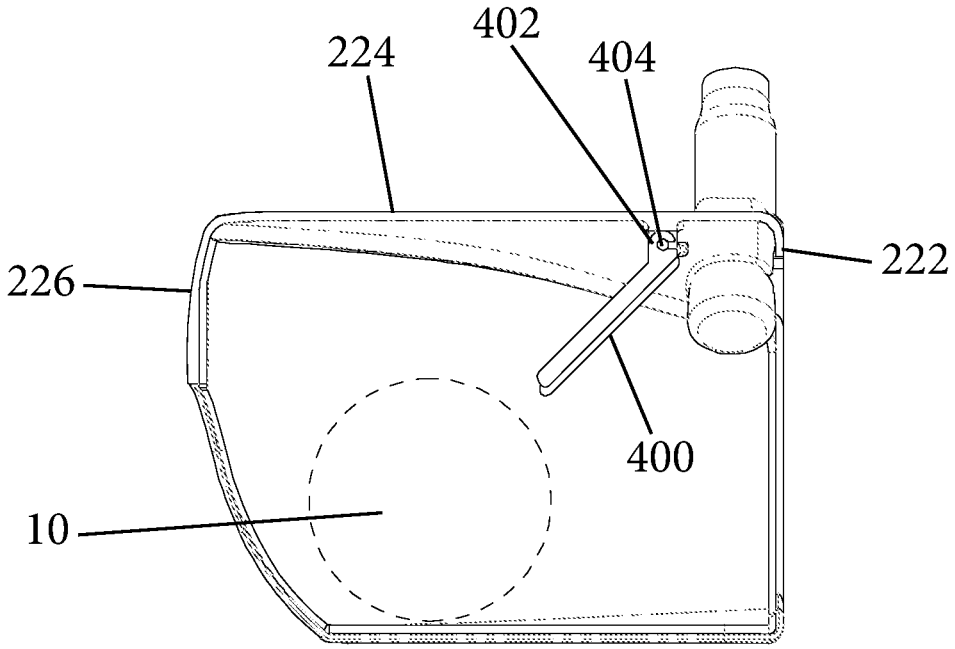
FIG. 6 is a side cross-sectional view showing the hinge element in the first position and the ball being captured in the ball capture space.

FIG. 4 shows the movable internal part 400 in a first position which is a lowered position, while FIG. 5 shows the movable internal part 400 in a second position which is a raised position. The movable internal part 400 can thus be a biased element in which the movable internal part 400 is biased to the lowered position of FIG. 4 (as by a spring or the like) or alternatively, the movable internal part 400 can be a non-biased element and instead be a swinging door as described below. The movable internal part 400 moves between the lowered position (FIG. 4) to the raised position (FIG. 5) upon application of a force to the movable internal part 400 and then returns to the lowered position when the force is removed (FIG. 6). In the present invention, this force is applied by the golf ball 10. In the raised position, there is sufficient space under the movable internal part 400 for the golf ball 10 to travel and thus, as the golf ball 10 enters the hollow interior space of the club head 200, the golf ball 10 contacts the movable internal part 400 and the continued forward swinging action of the club head 200 causes a rearwardly directed force to be applied to the movable internal part 400. As a result, the movable internal part 400 pivots about a pivot axis and pivots towards the rear wall 226 and ultimately toward the top wall 224 until it assumes the raised position of FIG. 5. The golf ball 10 continues to travel toward the rear wall 226 to a ball capturing space that is located within the hollow body 201 between the rear wall 226 and the movable internal part 400.

Once the golf ball 10 clears the movable internal part 400, the biasing nature of it or the gravitational force causes the movable internal part 400 to assume its at rest lowered position shown in FIG. 6. In this at rest lowered position, the captured golf ball 10 cannot travel underneath the movable internal part 400 and is thus effectively trapped within the ball capturing space.

To remove the captured golf ball 10, the movable internal part 400 can be raised by the user as by using a finger and the club head 200 can be tilted forward to cause the captured golf ball 10 to fall out of the club head 200 at its open front face or once the movable internal part 400 is in the raised position, the user can physically grasp and remove the golf ball 10. The captured golf ball 10 can be also ejected, once the movable internal part 400 is in the raised position, by contacting and pushing the captured golf ball 10 forward through the portion of the slot 220 formed in the rear wall 226.

It will be appreciated that the body head 201 can be formed of any number of different materials including but not limited to plastics, metals, or other suitable materials. In addition, the movable internal part 400 can be, at least partially, formed of the same material or different material than the body head 201. The movable internal part 400 can be formed of metal or plastic.

In accordance with one embodiment of the present invention, the body 201 can be formed of two different sections that mate together to form the unitary body 201.

The golf swing training aid 100 is constructed such that the user can easily learn how to properly swing the golf club and squarely line up with the golf ball for a desired driving of the golf ball. In particular, club head 200 is formed as a hollow structure with ball collection and retention properties such that when the golf club (the aid 100) is properly swung, the ball enters into the hollow interior of the club head 200 and is collected in the rear of the hollow interior compartment. The user will thus immediately know if the swing was a perfect swing. The training aid 100 thus allows the user to craft a perfect swing since the user will receive immediately feedback on the quality of the swing. Conversely, if the golf club is not properly swung, the golf ball will not enter into and be collected in the rear of the hollow interior compartment. Instead, the golf ball will contact the front face of the club head 200 and will be driven forward. The goal for the user is thus to craft the perfect swing where the golf ball is always captured within the rear of the hollow interior compartment due to the golfer's swing having optimal approach on the ball resulting in the ball entering into and being contained and collected within the club head 200. By continuing use of the golf swing training aid, the user will develop a desired and proper golf swing.

While the illustrated slot 220 is illustrated and discussed as being a continuous slot that extends continuously along the bottom wall and the rear wall, it will be understood that two separate slots can be formed, namely, one within the bottom wall and one within the rear wall.

The movable internal part 400 can be hingedly coupled to the top wall 224 as shown in FIG. 6. For example, the top edge of the movable internal part 400 can include a clamp portion 402 (e.g., wrench or C-shaped opening) that receives a pin 404 that is part of the club head body 201. The movable internal part 400 pivots about the pin 404. The movable internal part 400 can be biased with a biasing element, such as a spring, which effectively pulls the movable internal part 400 to the lowered position which represents the at-rest (normal) position. For example, the spring can be attached at one end to the club head body 201 and can be attached to an inner surface of the club head body 201 within the hollow interior compartment. In this sense, it is a spring tensioned hinged door.

Alternatively, the movable internal part 400 is not spring biased but instead is only hingedly connected to the front edge of the top wall 224 as shown in FIG. 6 using any number of techniques, including a snap-fit hinged connection. It is thus a non-tensioned spring door that freely swings about the pivot axis.

In yet another embodiment, the movable internal part 400 can be either fixedly attached to the front edge of the top wall 224 or it can be hingedly connected and in any event, it can be formed of a flexible material that flexes when a force is applied. Thus, when the ball 10 strikes the flexible internal part 400, it flexes rearwardly and the ball can travel underneath the flexed part 400. The plastic material can have memory properties in that it quickly returns to its original state.

It will be appreciated that other techniques can be used to cause the movable internal part 400 to assume the lowered position. For example, the bottom of the movable internal part 400 can be weighted to allows for natural gravitational pull to move the movable internal part 400 to the lowered position. The movable internal part 400 can also be formed to have an internal biasing feature as well that causes the part 400 to naturally assume the lowered position.

In the various embodiments, the range of motion of the pivoting door (internal part 400) would be approximately 90 degrees, one end of the range would be flush with the plane on which a clubface would otherwise be (i.e., vertical to the ground or just slightly angled inwards), and the other end of the range of motion would be flush with the interior top of the club head 200 (i.e., horizontal to the ground). In its resting state, the door (part 400) would be in its vertical position. When the user swings the device to a ball on a tee, the door (part 400) will swing inwards and upwards due to the inertia of the ball 10. Once the ball 10 is inside the interior of the clubhead 200, the door (part 400) will revert to its vertical position, thus trapping the golf ball 10 inside the clubhead 200. The door (part 400) measurements would be such that once a golf ball 10 is contained inside the device, the door (part 400) would prevent the ball 10 from falling out. To remove a trapped ball, one can push the door inwards and let the golf ball 10 drop out. Thus, the interior dimension of the clubhead 200 would be at least the width of a golf ball 10 plus the depth of the door (part 400).

Notably, the figures and examples above are not meant to limit the scope of the present invention to a single embodiment, as other embodiments are possible by way of interchange of some or all of the described or illustrated elements. Moreover, where certain elements of the present invention can be partially or fully implemented using known components, only those portions of such known components that are necessary for an understanding of the present invention are described, and detailed descriptions of other portions of such known components are omitted so as not to obscure the invention. In the present specification, an embodiment showing a singular component should not necessarily be limited to other embodiments including a plurality of the same component, and vice-versa, unless explicitly stated otherwise herein. Moreover, applicants do not intend for any term in the specification or claims to be ascribed an uncommon or special meaning unless explicitly set forth as such. Further, the present invention encompasses present and future known equivalents to the known components referred to herein by way of illustration.

The foregoing description of the specific embodiments will so fully reveal the general nature of the invention that others can, by applying knowledge within the skill of the relevant art(s) (including the contents of the documents cited and incorporated by reference herein), readily modify and/or adapt for various applications such specific embodiments, without undue experimentation, without departing from the general concept of the present invention. Such adaptations and modifications are therefore intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance presented herein, in combination with the knowledge of one skilled in the relevant art(s).

While various embodiments of the present invention have been described above, it should be understood that they have been presented by way of example, and not limitation. It would be apparent to one skilled in the relevant art(s) that various changes in form and detail could be made therein without departing from the spirit and scope of the invention.

Thus, the present invention should not be limited by any of the above-described exemplary embodiments, but should be defined only in accordance with the following claims and their equivalents.

What is claimed is:

1. A golf swing training aid comprising:

a golf club having a shaft and a club head, the club head having a hollow compartment for capturing a golf ball, the club head defined by a top wall, an opposing bottom wall, and a real wall, the club head having an open front face that forms an entrance into the hollow compartment, the club head having a slot formed within the bottom wall and extending completely to and being open at the front face of the club head so as to define an entrance to the slot for receiving a golf tee as the club head contacts the golf ball; and an internal movable part within the hollow compartment and moves between a raised position which allows the golf ball to travel to a rear ball capture space within the hollow compartment and a lowered position which is configured for capturing the golf ball within rear ball capture space located between the rear wall and the internal movable part.

2. The golf swing training aid of claim 1, wherein a width of the slot is less than a diameter of the golf ball.

3. The golf swing training aid of claim 1, wherein the slot formed in the bottom wall is open along a front edge of the bottom wall.

4. The golf swing training aid of claim 1, wherein the slot is also formed in the rear wall and has an L shape with a first leg being formed in the bottom wall and a second leg being formed in the rear wall, the first leg having a greater length than the second leg.

5. The golf swing training aid of claim 4, wherein a width of the slot is less than a diameter of the golf ball.

6. The golf swing training aid of claim 1, wherein a forward edge of the top wall is downwardly curled and a forward edge of the bottom wall is upwardly curled.

7. The golf swing training aid of claim 1, wherein the internal movable part comprises a flexible plastic part that has memory properties.

8. The golf swing training aid of claim 1, wherein a range of motion of the internal movable part is about 90 degrees from the raised position and the lowered position.

9. A golf swing training aid comprising:

a golf club having a shaft and a club head, the club head having a hollow compartment for capturing a golf ball, the club head defined by a top wall, an opposing bottom wall, and a real wall, the club head having an open front face that forms an entrance into the hollow compartment, the club head having a slot formed within the bottom wall and being open along the front face of the club head for receiving a golf tee as the club head contacts the golf ball; and an internal movable part within the hollow compartment and moves between a raised position which allows the golf ball to travel to a rear ball capture space within the hollow compartment and a lowered position which is configured for capturing the golf ball within rear ball capture space located between the rear wall and the internal movable part;

wherein the slot is also formed in the rear wall.

10. The golf swing training aid of claim 9, wherein the slot extends continuously from the bottom wall to the rear wall.

11. A method for training a golf swing of a user comprising the step of:

providing the golf swing training aid of claim 9;

swinging the golf swing training aid toward the golf ball that is supported on a golf tee; and receiving positive feedback that the golf swing was properly aligned with the golf ball by capturing the golf ball within the hollow compartment.

12. A golf swing training aid comprising:

a golf club having a shaft and a club head, the club head having a hollow compartment for capturing a golf ball, the club head defined by a top wall, an opposing bottom wall, and a real wall, the club head having an open front face that forms an entrance into the hollow compartment, the club head having a slot formed within the bottom wall and being open along the front face of the club head for receiving a golf tee as the club head contacts the golf ball; and an internal movable part within the hollow compartment and moves between a raised position which allows the golf ball to travel to a rear ball capture space within the hollow compartment and a lowered position which is configured for capturing the golf ball within rear ball capture space located between the rear wall and the internal movable part;

wherein the internal movable part comprises a pivotable door that extends downwardly from the top wall.

13. The golf swing training aid of claim 12, wherein the pivotable door is biased to the lowered position and is configured to pivot in a rearward direction toward the rear wall.

14. The golf swing training aid of claim 13, wherein the pivotable door is biased to the lowered position by a spring.

15. The golf swing training aid of claim 13, wherein when the pivotable door is in the raised position, a distance between a bottom edge of the pivotable door and the rear wall is greater than a diameter of the golf ball.

16. The golf swing training aid of claim 12, wherein a distance between a bottom edge of the pivotable door and the bottom wall, when the pivotable door is in the lowered position, is less than a diameter of the golf ball.

17. The golf swing training aid of claim 12, wherein a distance between a bottom edge of the pivotable door and the bottom wall, when the pivotable door is in the raised position, is greater than a diameter of the golf ball for allowing passage of the golf ball beneath the pivotable door to the rear ball capture space.

18. A golf swing training aid comprising:

a golf club having a shaft and a club head, the club head having a hollow compartment for capturing a golf ball, the club head defined by a top wall, an opposing bottom wall, and a real wall, the club head having an open front face that forms an entrance into the hollow compartment, the club head having a slot formed within the bottom wall and being open along the front face of the club head for receiving a golf tee as the club head contacts the golf ball; and an internal movable part within the hollow compartment and moves between a raised position which allows the golf ball to travel to a rear ball capture space within the hollow compartment and a lowered position which is configured for capturing the golf ball within rear ball capture space located between the rear wall and the internal movable part;

wherein the internal movable part has a weighted bottom section to cause the internal movable part to return to the lowered position after an applied rearwardly directed force is removed.

* * * * *